US006722375B1

(12) United States Patent
Falls

(10) Patent No.: US 6,722,375 B1
(45) Date of Patent: Apr. 20, 2004

(54) MIRACLE CURLERS

(76) Inventor: Lani T. Falls, 212 W. Brigantine Ave., Brigantine, NJ (US) 08203

( * ) Notice: Subject to any disclaimer, the term of this patent is extended or adjusted under 35 U.S.C. 154(b) by 0 days.

(21) Appl. No.: 10/345,376

(22) Filed: Jan. 16, 2003

(51) Int. Cl.[7] ..... A45D 7/04; A45D 2/18
(52) U.S. Cl. ..... 132/207; 132/246
(58) Field of Search ..... 132/221, 222, 132/207, 246, 333

(56) References Cited

U.S. PATENT DOCUMENTS

| | | | | | |
|---|---|---|---|---|---|
| 1,664,023 | A | * | 3/1928 | Oulson | 132/206 |
| 1,710,216 | A | * | 4/1929 | James | 132/246 |
| 2,334,417 | A | * | 11/1943 | Labelle et al. | 132/221 |
| 2,524,266 | A | * | 10/1950 | Licastro | 132/246 |
| 2,525,981 | A | | 10/1950 | Webster | |
| 2,601,428 | A | | 6/1952 | Bonneau | |
| 2,693,809 | A | | 11/1954 | Spencer | |
| 2,756,756 | A | * | 7/1956 | Schepis | 132/246 |
| 3,418,194 | A | | 12/1968 | Loftice | |
| 4,310,008 | A | | 1/1982 | Lalli | |
| 4,892,110 | A | | 1/1990 | Harvie | |
| 5,372,152 | A | | 12/1994 | Dutch | |
| 5,404,892 | A | | 4/1995 | Bretl | |
| 5,411,040 | A | * | 5/1995 | Forrest | 132/211 |
| 5,694,955 | A | | 12/1997 | Grooms | |
| 5,813,419 | A | | 9/1998 | Brams | |
| 6,123,085 | A | * | 9/2000 | Johnson | 132/246 |
| 6,363,945 | B1 | | 4/2002 | Roberson | |

* cited by examiner

*Primary Examiner*—Todd E. Manahan

(57) ABSTRACT

An apparatus and method for curling hair using sheets of paper is shown and described in detail. Two sheets of paper are used to fold a locket of hair and attach the hair adjacent the user's scalp for curling. The curlers are disposable after use. Each sheet is folded in a unique pattern to hold the hair during curling and to connect the sheets together. The method permits the user access to curlers during travel.

14 Claims, 3 Drawing Sheets

FIG. 5
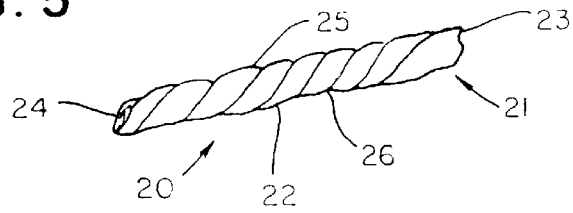
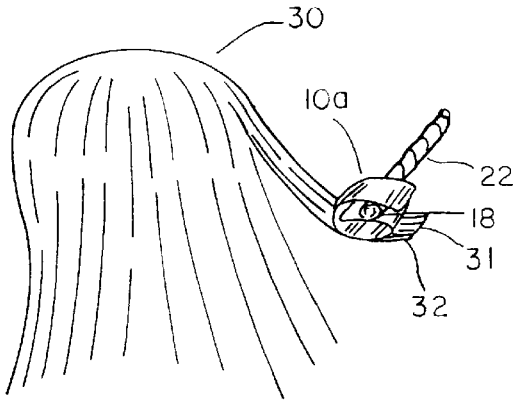
FIG. 6
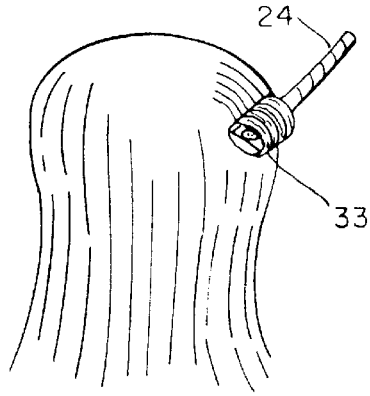
FIG. 7
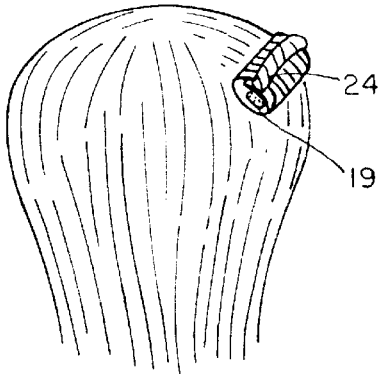
FIG. 8
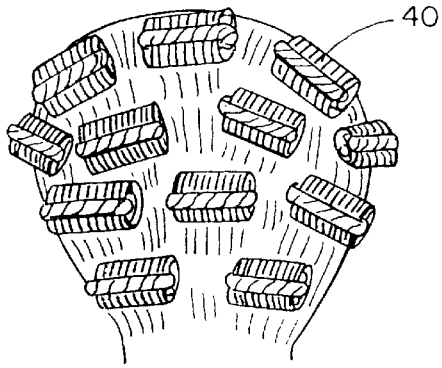
FIG. 9

MIRACLE CURLERS

FIELD OF THE INVENTION

The present invention relates to a method and device for curling hair using conventional disposable sheets of paper such as toilet or tissue paper. A roll of toilet paper is commonly provided to guests of hotels. The present invention provides a method and device for using the paper to form curlers which may be used by the guest. The availability of the sheets makes the invention a desirable product for those travelers who would rather not bring plastic or conventional curlers on a trip.

BACKGROUND OF THE INVENTION

Conventional curlers used to curl hair are commonly sold in a container and are often accompanied by a curling iron and other hair supply products. The container is usually the size of a small suitcase which must be packed inside a larger suitcase or carried separately by hand. The additional suitcase or storage space taken up by the curlers is an extra burden for the traveler.

There are many patents on curlers. Most curlers include surfaces for catching the hair or clips for supporting a locket of hair on a curler roller. These curlers are reusable and may be cleaned in a dishwasher or by hand. For example, the patent to Grooms U.S. Pat. No. 5,694,955 discloses a device for curling hair having a soft deformable core with two ends and a rolling surface. Bonneau U.S. Pat. No. 2,601,428 discloses a hair curler made of an envelope of tin foil, wire tie and paper sheets. Brams U.S. Pat. No. 5,813,419 discloses a hair curler made of sheet semi-rigid material. All of these curlers are factory made curlers designed for sale and reuse.

Although there have been many attempts to invent the perfect curler, all the curlers mentioned above fail to provide the user with a simple inexpensive answer. There is a need for a disposable curler in the industry. Moreover, there is a need in the industry for a hair curling solution which is readily available at most hotel rooms or in most households.

SUMMARY OF THE INVENTION

An object of the present invention is to provide a method of curling hair on a live human or animal using a roll of perforated sheet material which has been perforated into removable sections of sheet material.

Another object of the present invention is to provide a method of curling hair using sheet materials in the form of polygon shaped blanks.

Yet another object of the present invention is to provide a curler formed from two sheets of paper material.

A sheet of paper approximately four inches by four inches is removed from a perforated roll of paper, such as toilet paper. The sheet of material is folded to form two ends including a first pocket and a second pocket. A second sheet of material is removed from the roll and twisted to form an elongated twisted sheet of material having two ends.

The second sheet of material is folded and each end is inserted into a corresponding pocket of the first sheet of material to form an opening for receiving a section of hair. The paper sheets may dipped in permanent solution or water prior to use. After inserting a section of hair, the paper and the hair are rolled into a curl adjacent the user's scalp. Finally, the curler and hair may be heated to curl the hair.

DETAILED DESCRIPTION OF DRAWINGS

FIG. 5 depicts a plan view of a second sheet twisted to form a twisted article.

FIG. 6 depicts a plan view of a curler of the present invention on a users head.

FIG. 7 illustrates a plan view of the curler prior to attachment.

FIG. 8 illustrates plan view of an attached curler.

FIG. 9 illustrates a plan view of plurality of attached curlers.

DESCRIPTION OF THE PREFERRED EMBODIMENTS

A method and apparatus of the present invention is illustrated in FIGS. 1–11 and relates to the field of hair curlers. The present invention as described and illustrated relates to a method and apparatus for curling hair. While the method and apparatuses are described in detail, the primary purpose of the invention provides a means and method for curling hair during travel when typical curlers are not available. Typical situations include hotel or travel stay where toilet paper is provided by the establishment.

Figure 1:
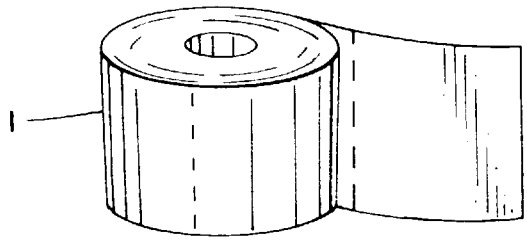
FIG. 1 depicts a plan view sheet of paper from a standard roll of toilet paper.

Depicted in FIG. 1, is a roll of ordinary toilet paper 1 having perforated sheets which may be individually removed from the roll. Other types of sheet material may be used such as paper towels, parchment paper, tissue paper, wax paper or cellophane. The sheets used in the present invention should have dimensions of no greater then 12×12 inches and preferably 4×4 inches. Two sheets of paper are used to form each curler.

Figure 2:
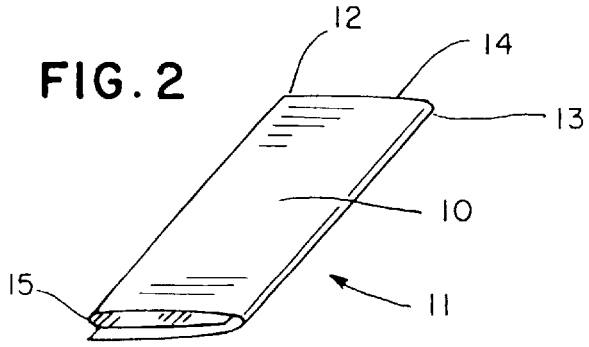
FIG. 2 depicts a plan view the sheet of paper from the roll of paper folded into an elongated sheet.
Figure 3:
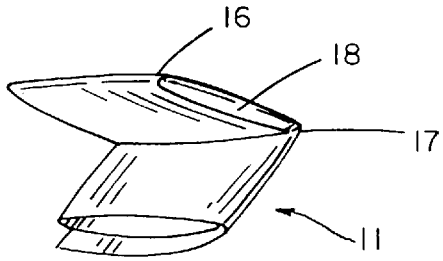
FIG. 3 depicts a plan view of the sheet of paper during the folding step.
Figure 4:
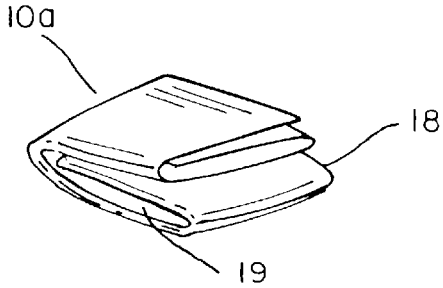
FIG. 4 depicts a plan view of a polygon shaped article of the present invention.

FIG. 2 shows a sheet of paper 10 from the roll 1. The sheet 10 is first folded end over end to form an elongated folded article 11 having fold lines 12, 13 a folding end 14 and a stationary end 15. Turning to FIG. 3, end 14 is then folded to create an elongated first fold line 16 and an elongated second fold line 17. In final formation, the sheet 10 which now become a polygon shaped article 10*a* has a first pocket 18 and a second pocket 19 as depicted in FIG. 4.

In FIG. 5, a second sheet of material 20 is then used to form a second section 21 of said curler. Sheet 20 is removed from the roll 1 and twisted to form twisted article 22 by turning first article end 23 and a second end 24 in opposite directions. The twisting motion creates peaks 25 and valleys 26 in the article 22.

FIG. 6 shows a users head 30 and hair for application of the present invention. The method and apparatus will now be described in detail. A locket or section of hair 31 is selected for curling. The section of hair 31 is pulled away from the head and the polygon shaped article 10*a* is placed on the locket at end 32. The twisted article 22 is then connected to the polygon shaped article by inserting a first end 23 of the twisted article into first pocket 18 of the polygon shaped article 10*a*. The end 32 of the hair 31 is then folded over the polygon shaped article 10*a* repeatedly until folded section 33 of hair 31 and the polygon shaped article 10*a* are adjacent the head of the user as shown in FIG. 7.

After the folded hair section 33 is next to the users head, the second end 24 of the twisted article is inserted into the second pocket 19 of the polygon shaped article 10*a* to lock the hair and curler 40 next to the scalp of the user. A next section of hair may then be selected from the user's hair for application of the curler. This process is continued until the all the hair is in curlers. FIG. 9 illustrates the head with all of the hair secured by curlers 40.

Prior to application of the sheets to the process, each sheet may be dipped in curling solution, conditioning solution or any other hair treatment solution such as coloring or relaxing. The ribs and valleys of the twisted article provide an effective means for locking the folded section of hair to the polygon shaped article. Hair spray may also be applied to the curlers to assist the curlers in holding the hair after or during the curling process.

Figure 10:
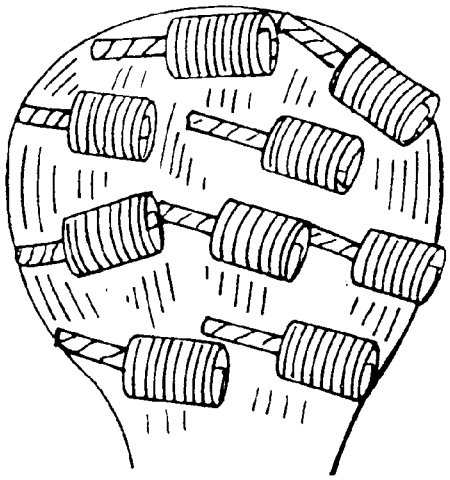
FIG. 10 illustrates an alternate embodiment of the invention.

An alternative embodiment is shown in FIG. 10. Instead of tucking the second end of the twisted member, the twisted member remains in an extended position, and the hair is rolled into curling formation. The curling solution is then applied and the extended member remains flat on the surface of the user's head.

Figure 11:
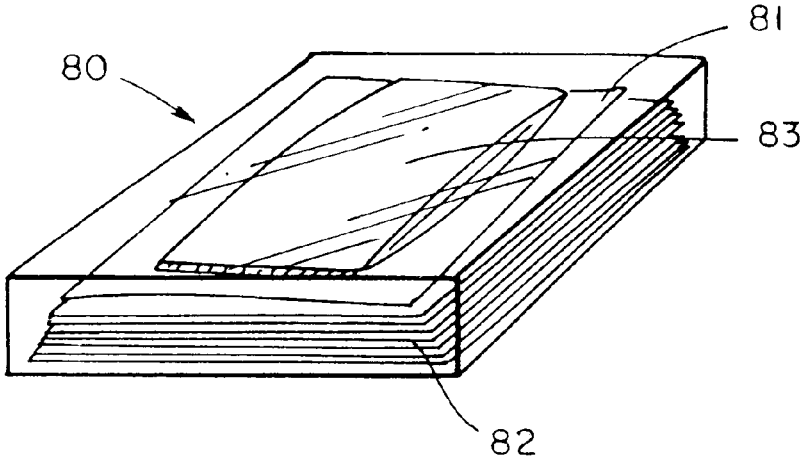
FIG. 11 illustrates a package of the curlers.

In FIG. 11, an embodiment is shown wherein a package 80 of paper towels is included with a paper inset of instructions 81 for applying a series of curlers to a user's hair. The package includes at least 20–50 paper towels 82, a sealed foil container 83 of curling solution and a sheet bearing instructions 81 for a novel method of curing hair as outlined in the previous embodiments. The container 83 of curling solution is positioned on top of the paper towels 82.

What is claimed is:

1. A method of curling hair on a live human or animal using a roll of perforated sheet material which has been perforated into removable sections of sheet material having a width of four inches or less and a length of four inches or less, said method including the following steps, removing a first sheet of material from said roll of said perforated sheet material and folding said first sheet of material end over end in a first direction to form an elongated article having two ends and folding said elongated article end over end to form a first pocket and a second pocket of a polygon shaped article, removing a second sheet of material from said roll of perforated sheet material and twisting said second sheet of material to form a twisted article having a first twisted end and a second twisted end, inserting said first twisted end into said first pocket of said polygon shaped article, grasping an end of a locket of hair from said user's head and placing said polygon shaped article on said end of hair, rolling said hair and said polygon shaped article until the polygon shaped article and roll of hair are adjacent the user's head, and inserting said second end of said twisted article into said second pocket of said polygon shaped article to form a curler.

2. The method of curling hair as recited in claim 1, with the additional step of wetting said hair before attaching said polygon shaped article.

3. The method of curling hair as recited in claim 1, with the additional step of spraying said hair with hair spray before removing said curler.

4. The method of curling hair as recited in claim 1, said sheet material made of tissue paper.

5. The method of curling hair as recited in claim 1, said sheet material made of cellophane.

6. The method of curling hair as recited in claim 1, said sheet material made of wax paper.

7. The method of curling hair as recited in claim 1, said sheet material made of air laid paper.

8. The method of curling hair as recited in claim 1, said sheet material made of parchment paper.

9. A method of curling hair on a live human or animal using a roll of perforated sheet material, said method including the following steps, removing a first sheet of material from said roll of said perforated sheet material and folding said first sheet of material end over end in a first direction to form an elongated article having two ends and folding said elongated article end over end to form a first pocket and a second pocket of a polygon shaped article, and dipping said article in curling solution, removing a second sheet of material from said roll of perforated sheet material and twisting said second sheet of material to form a twisted article having a first twisted end and a second twisted end, inserting said first twisted end into said first pocket of said polygon shaped article, grasping an end of a locket of hair from said user's head and placing said polygon shaped article on said end of hair, rolling said hair and said polygon shaped article until the polygon shaped article and roll of hair are adjacent the user's head, and;

inserting said second end of said twisted article into said second pocket of said polygon shaped article to form a curler.

10. The method of curling hair as recited in claim 9, with the additional step of wetting said hair before attaching said polygon shaped article.

11. The method of curling hair as recited in claim 7, with the additional step of spraying said hair with hair spray before removing said curler.

12. The method of curling hair as recited in claim 11, said sheet material made of tissue paper.

13. The method of curling hair as recited in claim 12, with the additional step of spraying said hair with hair spray before removing said curler.

14. A curler for treating hair in order to form a curl, said curler comprising a first sheet of material, first sheet of material including fold lines and two ends forming a first pocket and a second pocket, a second sheet of material, said second sheet of material having a first twisted end and a second twisted end, and said first sheet and said second sheet being connected by folding said twisted elongated second sheet of material and inserting said first twisted end into said first pocket of said folded first sheet of material and inserting said second twisted end into said second pocket of said folded first sheet of material to form an opening for receiving a section of hair.

* * * * *